United States Patent [19]

Paine

[11] Patent Number: 4,613,939

[45] Date of Patent: Sep. 23, 1986

[54] PROGRAMMABLE SERVICE REMINDER APPARATUS AND METHOD

[75] Inventor: John C. Paine, Chardon, Ohio

[73] Assignee: Caterpillar Industrial Inc., Mentor, Ohio

[21] Appl. No.: 638,922

[22] Filed: Aug. 8, 1984

[51] Int. Cl.[4] ..... G07C 5/10

[52] U.S. Cl. ..... 364/424; 364/569

[58] Field of Search ..... 364/424, 550, 551, 569; 377/20; 340/52 R, 52 F

[56] References Cited

U.S. PATENT DOCUMENTS

| | | | |
|---|---|---|---|
| 4,031,363 | 6/1977 | Freeman et al. | 364/424 |
| 4,067,061 | 1/1978 | Juhasz | 364/424 |
| 4,159,531 | 6/1979 | McGrath | 364/900 |
| 4,258,421 | 3/1981 | Juhasz et al. | 364/424 |
| 4,506,337 | 3/1985 | Yasuhara | 364/550 |
| 4,523,283 | 6/1985 | Muhlberger et al. | 364/550 |
| 4,525,782 | 6/1985 | Wohlfarth et al. | 364/551 |
| 4,533,900 | 8/1985 | Muhlberger et al. | 364/424 |
| 4,542,461 | 9/1985 | Eldridge et al. | 364/424 |

*Primary Examiner*—Gary Chin

*Attorney, Agent, or Firm*—Stephen L. Noe

[57] ABSTRACT

Electronic hourmeter devices having service reminders are useful, for example, in industrial vehicles. Advantageously, such service reminders should be field programmable for a variety of predetermined service intervals. The subject electronic service reminder is readily field programmable by authorized personnel and is protected from being programmed or reset by unauthorized personnel. A service status indicator is activated in response to the elapsed hourmeter time exceeding the programmed service interval time, and both the hourmeter elapsed time and the service reminder programmed time are resettable in response to a predetermined magnetic flux applied to respective Hall effect switches. Data is advantageously maintained in a non-volatile memory device without need for a battery back-up.

9 Claims, 6 Drawing Figures

STATIC MEMORY
DYNAMIC MEMORY
CE
DO
DI
SK
REGULATOR
VBAT
VBAT
10
30
32
34
36
38
40
42
94
96
98
100
102
104
106
108
110
112
114
116
118
120

PROGRAMMABLE SERVICE REMINDER APPARATUS AND METHOD

DESCRIPTION

1. Technical Field

This invention relates generally to an apparatus and method for indicating an elapsed period of time, and, more particularly, to an apparatus and method for indicating that a particular operating condition has occurred for a predetermined programmable period of time.

2. Background Art

Hourmeters of various types are commercially available and are in common use today. In response to the occurrence of a particular operating condition, for example, the energization of a vehicle such as an industrial lift truck, a time base periodically increments a counter, either mechanical or electronic, and displays, accumulates and stores the total amount of time the sensed condition occurs.

In the case of an hourmeter used in conjunction with a vehicle or other mechanical device, it is often useful to provide an indication that a predetermined period of time has elapsed. For example, periodic maintenance is often performed in response to the accumulation of a predetermined number of hours of use of a vehicle. Various devices have been provided in the past to produce such a service time indication. For example, a mechanical flag can be associated with the rotating wheels of a mechanical counter and displayed in response to a predetermined rotation of the counter wheels. In electronic hourmeter systems a visual or audible signal is commonly produced in response to the elapsed period of time.

Regardless of the type of indication employed, some means must be provided to establish the predetermined time interval after which the service indicator is to be activated. In the past, this time interval has typically been established by the manufacturer of the equipment involved. For example, in the case of a lift truck, an average service interval might be considered by the manufacturer to be 250 hours. Responsively, the service indicator is programmed to be automatically activated after 250 hours of vehicle use.

However, as is widely recognized by both manufacturers and equipment users, one universally acceptable service interval cannot be established and employed in every case. The actual time at which service should be performed varies according to the circumstances under which the vehicle is used and according to the age of the vehicle. For example, a new vehicle can require an increased frequency of maintenance during an initial break-in period, and a reduced frequency following the break-in period. In a similar manner, a vehicle used under adverse conditions or subjected to extremely hard use can require maintenance more frequently than average. The conventional service reminder cannot accommodate such varying requirements, and can even forestall needed maintenance by failing to properly indicate an appropriate time for performing needed maintenance.

Once a service reminder indication is produced by the hourmeter, means must be provided to reset the indicator to the "off" position. Advantageously, such reset means should be readily accessible to personnel having maintenance responsibility, while remaining relatively inaccessible to non-authorized personnel such as the vehicle operator. Prior service reminders have frequently been rendered unreliable because the service indicator was resettable by the operator who was annoyed by the indicator, or have not been fully utilized because the reset mechanism was inconvenient for maintenance personnel to access.

The present invention is directed to overcoming one or more of the problems as set forth above.

DISCLOSURE OF THE INVENTION

In one aspect of the present invention a programmable service reminder apparatus for a vehicle is provided. The apparatus includes a sensor for producing a control signal in response to the vehicle being energized, and a clock for producing a time base signal. A service status indicator is provided for signaling an elapsed period of time. A first switch produces a service time reset signal and a programmable memory device is provided for receiving and storing data. A processor procuces an elapsed time signal and periodically delivers it to the memory device. The processor also sequentially produces each of a plurality of predetermined service time signals in response to receiving the service time reset signal for respective successive continuous predetermined periods of time, combines the elapsed time signal and the produced predetermined service time signal and responsively delivers the combined time signal to the memory device. In addition, the processor compares the elapsed and combined time signals and energizes the service status indicator in response to the elapsed time signal being greater than the combined time signal.

In a second aspect of the present invention, a method for indicating a predetermined programmable elapsed vehicle service time period is provided. The method includes the steps of producing a control signal in response to the vehicle being energized, producing a time base signal, and signaling an elapsed period of time. A service time reset signal is also produced. An elapsed time signal is produced and periodically delivered to a memory. Each of a plurality of predetermined service time signals is sequentially produced in response to receiving the service time reset signal for respective successive continuous predetermined periods of time. The elapsed time signal and the produced predetermined service time signal are combined and the combined time signal is delivered to the memory. The elapsed and combined time signals are compared and a service status indicator is energized in response to the elapsed time signal being greater than the combined time signal.

The present invention produces a service reminder indication in response to a predetermined operating time having elapsed. The predetermined service time is fully field programmable to suit the operating conditions of a particular vehicle. The reset and programming devices are fully available to authorized personnel and at the same time are protected from tampering by unauthorized personnel. Advantageously, the instant invention is fully electronic and stores data in a non-volatile memory device without the need for a battery back-up system. The number of bit changes occurring in the non-volatile memory device is minimized to prolong the useful life of the device.

BRIEF DESCRIPTION OF THE DRAWINGS

For a better understanding of the present invention, reference may be made to the accompanying drawings, in which.

BEST MODE FOR CARRYING OUT THE INVENTION

Figure 1:
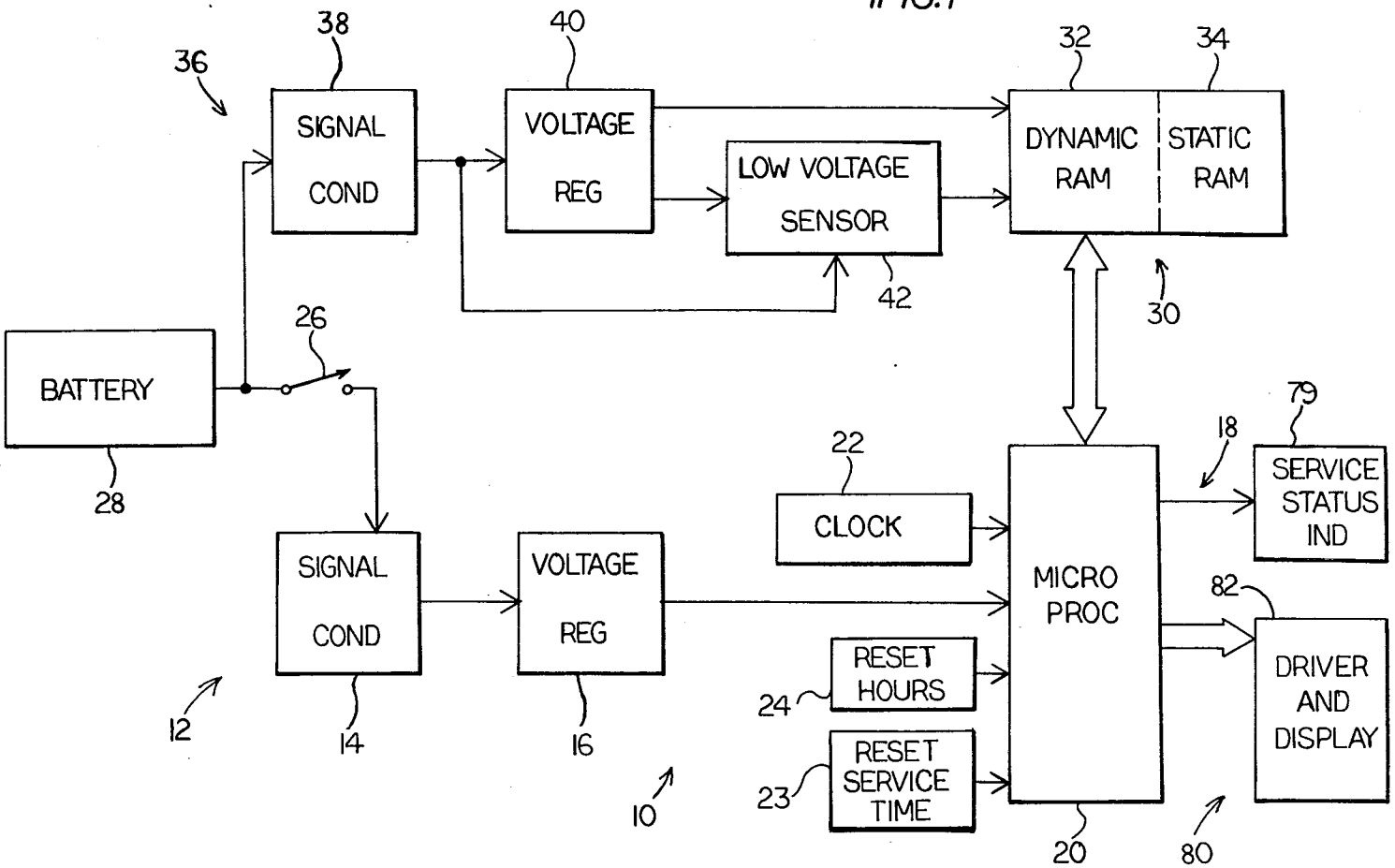
FIG. 1 is a block diagram incorporating one embodiment of the present invention.

Referring first to FIG. 1, an apparatus embodying certain of the principles of the present invention is generally indicated by the reference numeral 10. It should be understood that the following detailed description relates to the best presently known embodiment of the apparatus 10. However, the apparatus 10 can assume numerous other embodiments, as will become apparent to those skilled in the art, without departing from the appended claims.

FIG. 1 is a block diagram of one embodiment of the present invention. Sensor means 12 for producing a control signal in response to energizing a vehicle includes a signal conditioner 14 connected to a voltage regulator 16. The output of the voltage regulator 16 is connected to processor means 18, for example, a microprocessor 20. Clock means 22 for producing a time base signal also connects to the processor means 18. Input to the signal conditioner 14 is, for example, through a switch 26 connected to a power supply, such as a vehicle battery 28. Programmable memory means 30 for receiving and storing data, containing both a dynamic memory device 32 and a non-volatile memory device 34, is also connected to the processor means 18.

The vehicle battery 28 is connected directly to means 36 for sensing the vehicle battery voltage and transferring the contents of the dynamic memory 32 to the non-volatile memory 34 in response to the vehicle battery voltage being less than a predetermined magnitude. The sensing means 36 includes a second signal conditioner 38 having an input connected to the vehicle battery 28. The output of the second signal conditioner 38 is connected to the input of a second voltage regulator 40 and to one input of a low voltage sensor means 42. A first output of the second voltage regulator 40 is connected to a second input of the low voltage sensor means 42. The output of the low voltage sensor means 42 and a second output of the second voltage regulator 40 are each connected to the memory device 30.

First switch means 23 for producing a service time reset signal and second switch means 24 for producing an elapsed time reset signal are also connected to inputs of the processor means 18. Service status indicator means 79 for signaling an elapsed period of time is connected to an output of the processor means 18, as is means 80 for controllably accessing and decoding the contents of the memory device 30 and displaying a number representing the decoded value.

Figure 2:
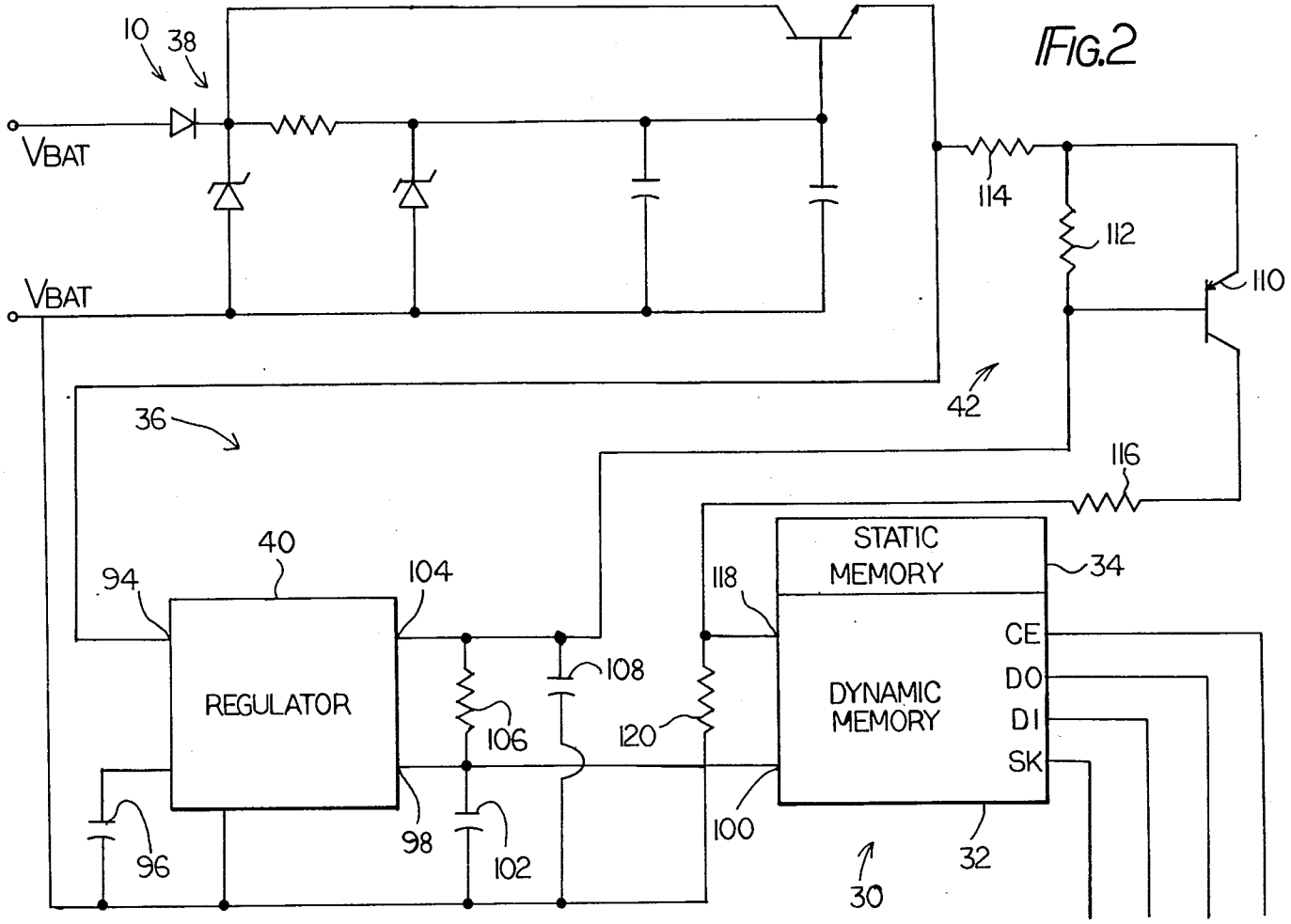
FIGS. 2 and 3 are a schematic representation of one embodiment of the present invention; and, FIGS. 4, 5, and 6 are a flowchart of software used with one embodiment of the present invention.
Figure 3:
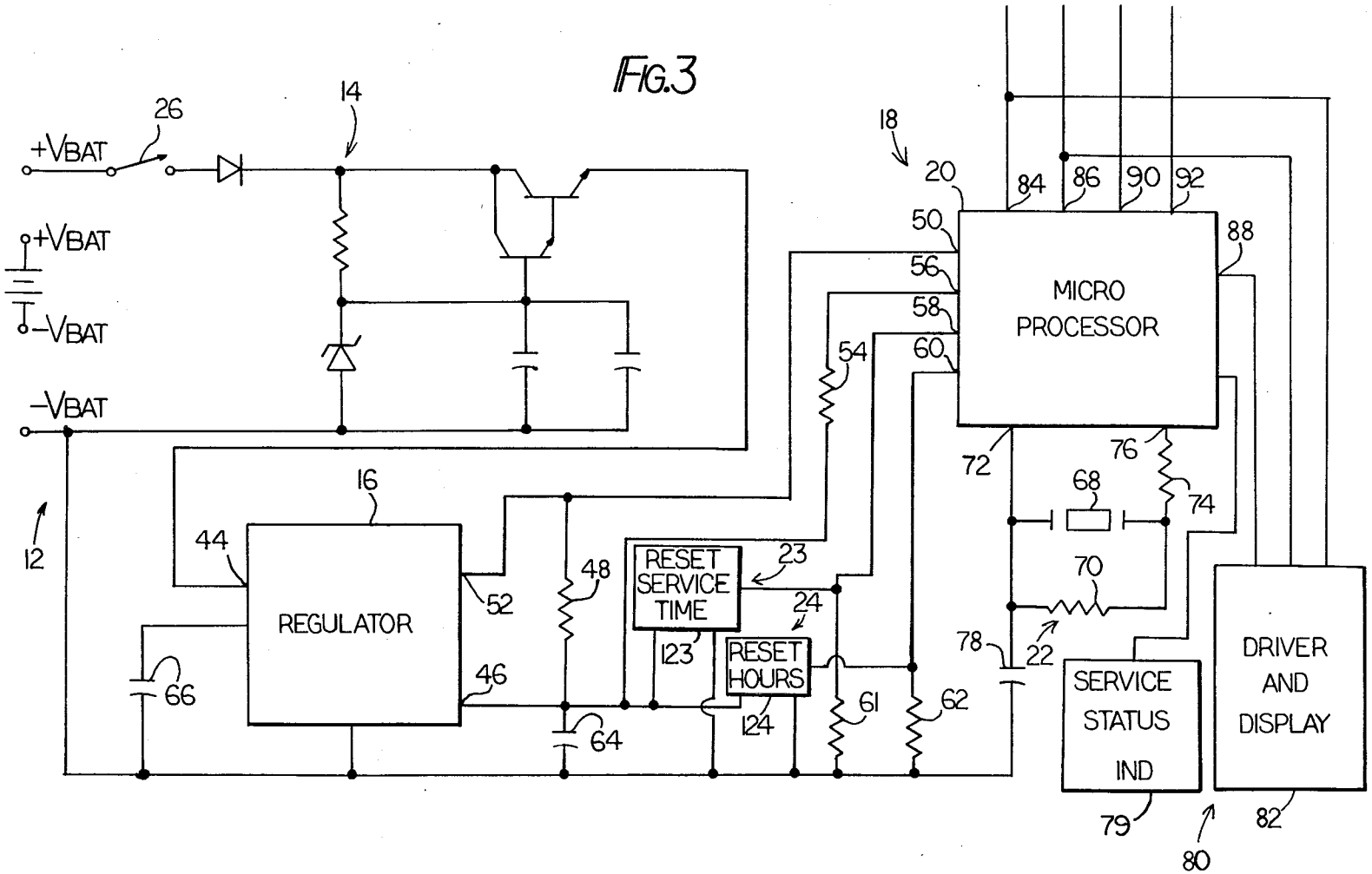

FIGS. 2 and 3 together constitute a schematic diagram of an embodiment of the present invention. Throughout the discussion of FIGS. 2 and 3, connections to the vehicle battery 28 are referred to as + and $-V_{BAT}$. In FIG. 3, the receiving means 12 includes a first signal conditioner 14 connected through a switch 26 to $+V_{BAT}$. The switch 26 is, for example, a portion of an ignition switch of the vehicle. The signal conditioner 14 is a conventional noise filtering and signal debouncing circuit.

The output of the signal conditioner 14 is delivered to an input terminal 44 of the first voltage regulator 16. The voltage regulator 16 is, for example, a model L487B manufactured by SGS-ATES Electronics of Phoenix, Ariz. An output terminal 46 of the voltage regulator 16 is connected through a resistor 48 to a "reset" terminal 50 of the processor means 18. The "reset" terminal 50 is also connected to a "reset" output 52 of the voltage regulator 16. The output terminal 46 is also connected through a resistor 54 to an input terminal 56 of the processor means 18 and to the first and second switch means 23,24. The first service time reset switch means 23 is connected to an input terminal 59 of the processor means 18 and through a resistor 61 to $-V_{BAT}$. The second elapsed time reset switch means 24 is connected to a different input terminal 60 of the processor means 18 and through a respective resistor 62 to $-V_{BAT}$. A capacitor 64 is also connected from the output terminal 46 to $-V_{BAT}$, and a delay capacitor 66 is connected from a delay output terminal of the first voltage regulator 16 to $-V_{BAT}$.

The first and second switch means 23,24 are preferably magnetic flux responsive means, for example, Hall effect switches 123,124, and produce a reset signal in response to a predetermined magnetic flux field. Each of the Hall effect switches 123,124 has an output connected to the respective input port 59,60 of the processor means 18. The use of Hall effect devices 123,124 instead of conventional switches, in the preferred embodiment, facilitates controlling access to the reset means 23,24 of the apparatus 10. The Hall effect devices 123,124 can be, for example, contained within a sealed enclosure housing the apparatus 10, and can be activated only by positioning a suitably magnetized tool or key in a predetermined location external to the enclosure. Therefore, authorized personnel are readily able to reset the apparatus 10 while one not familiar with the reset procedure or not possessing the proper reset tool is frustrated in attempts to reset the apparatus 10.

Clock means 22 for producing a time base signal includes a quartz crystal 68 connected in parallel with a resistor 70. One end of the parallel combination is connected to an input port 72 of the processor means 18 and the other end of the parallel combination is connected through a resistor 74 to an input port 76. The input port 72 is also connected through a capacitor 78 to $-V_{BAT}$. The quartz crystal 68 is, for example, a conventional 3.58 megahertz color burst crystal.

Means 80 for controllably accessing and decoding the contents of the memory and displaying a number representing the decoded value includes a driver and display device 82. A serial clock output port 84, serial output port 86, and data load, port 88 of the processor means 18 are connected to the display means 80. The service status indicator means 79 for signaling an elapsed period of time is connected to an output port 93 of the processor means 18. In the preferred embodiment, the service status indicator means 79 is a liquid crystal indicator and can be part of the driver and display device 82.

Referring now to FIG. 2, the serial clock and serial output ports 84,86 as well as the serial input port 90 and chip enable port 92 are connected to respective terminals of the random access memory device 30. The second signal conditioner 38 of the sensing means 36 is connected to $+V_{BAT}$ and serves as a conventional signal filtering element. The output of the signal conditioner 38 is connected to an input 94 of the second voltage regulator 40. The second voltage regulator 40 is preferably of the same type as the first voltage regulator 16. A delay capacitor 96 is connected from the second voltage regulator 40 to $-V_{BAT}$.

A "reset" output terminal 98 of the second voltage regulator 40 is connected to a "recall" terminal 100 of the memory device 30, to $-V_{BAT}$ through a capacitor 102, and to a first output terminal 104 of the second voltage regulator 40 through a resistor 106. The second output terminal 104 is connected to $-V_{BAT}$ through a capacitor 108 and to the low voltage sensor means 42.

The low voltage sensor means 42 includes a transistor 110 having a base connected to the second output terminal 104 and an emitter connected to the base through a resistor 112. The emitter of the transistor 110 is also connected to the output of the signal conditioner 38 through a resistor 114. A collector of the transistor 110 is connected through a collector resistor 116 to a "store" terminal 118 of the memory device 30 and through a resistor 120 to $-V_{BAT}$.

The ratings, values, and manufacturers shown for various electrical elements discussed above are for exemplary purposes only. Alterations of the circuit and embodiment discussed and the use of electrical elements of different constructions or ratings will be apparent to those skilled in the art. Such alterations or substitutions can be implemented without departing from the appended claims.

INDUSTRIAL APPLICABILITY

Operation of the apparatus 10 is best described in relation to its use on a vehicle, for example, an industrial vehicle such as an electric lift truck. The switch 26 supplies battery voltage from the vehicle battery 28 to the receiving means 12 in response to closing the ignition switch of the vehicle. Responsively, a signal is delivered from the output terminal 46 of the first voltage regulator 16 through the resistor 48 and the resistor 54 to the terminals 50,56 of the processor means 18.

The processor means 18 includes a microprocessor 20 as described above. The microprocessor 20 includes as an integral part thereof a working memory area. For the purposes of this invention, a portion of the working memory area contains a plurality of time interval registers. The processor means 18 receives the control signal and the clock frequency signal and controllably increments or modifies predetermined ones of the plurality of time interval registers in response to receiving both the control signal and a predetermined number of cycles of the clock frequency signal.

The memory device 30 includes both a dynamic random access memory device 32 and a non-volatile random access memory device 34 constructed in a single package, for example, model No. X2443PI, manufactured by XICOR of Milpitas, Calif.

Communication between the processor means 18 and the memory device 30 always involves the dynamic memory device 32. Data is transferred or copied to and from the non-volatile memory device 34 through the dynamic memory device 32. Data transfer is initiated either by a specific instruction from the processor means 18 or by the application of a predetermined logic signal to one of the "store" and "recall" terminals 118,100 of the memory device 30.

In the preferred embodiment, each cycle from the clock means 22 is counted in the internal working memory and is used to control the timekeeping functions of the apparatus 10. The processor means 18 stores a representation of the contents of the time interval registers in the dynamic memory device 32 in response to each modification of a first predetermined one of the time interval registers, and transfers the contents of the dynamic memory device 32 to the non-volatile memory device 34 in response to each modification of a second predetermined one of the time interval registers. The sensing means 36 senses the vehicle battery voltage and transfers or copies the contents of the dynamic memory device 32 to the non-volatile memory device 34 in response to the vehicle battery voltage being less than a predetermined magnitude.

Both the dynamic and non-volatile portions of the memory device 30 are identically organized as 16 bit by 16 bit digital arrays. Individual time interval registers are created and maintained in the memory device 30 for a plurality of time intervals, specifically 1/16th hour, 1 hour, 10 hours, 100 hours, and 1000 hours. Each of these time interval registers is maintained in the dynamic memory device 32 and is periodically stored in the non-volatile memory device 34. A representation of the contents of at least a first one of the time interval registers is stored in both the dynamic and non-volatile memory devices 32,34 as a binary coded decimal number, and a representation of the contents of at least a second one of the time interval registers is stored in both the dynamic and non-volatile memory devices 32,34 as a gray coded binary number. Further, the addressable memory location in which at least one of the gray coded binary numbers is stored is selected and varies systematically in response to the value of a predetermined different one of the stored numbers. In addition, a plurality of predetermined service time intervals are stored in fixed memory locations in the non-volatile memory device 34, as is a combined time signal formed by mathematically combining the elapsed time signal and a predetermined one of the service time signals.

In the preferred embodiment, the 1000 hour and 100 hour time interval registers are stored as 4 bit binary coded decimal numbers in a first 8 bits of a first row of each memory device 32,34. The 10 hour, 1 hour, and 1/16th hour time interval registers are stored in the memory devices 32,34 as 8 bit gray coded binary numbers. The 8 bit gray code, shown in Table 1, is designed such that each of the 8 bits changes logic state only two times during a complete counting cycle from zero through 15 and back to zero again. This is in marked contrast to the conventional binary coded decimal format in which the least significant bit changes logic state 16 times during the same 0-15-0 counting cycle. The 10 hour register is stored as the second 8 bits of the first row of each of the memory devices 32,34. The 1 hour and 1/16th hour time interval registers are stored as respective 8 bit gray coded binary numbers in a second row of each of the memory devices 32,34. Owing to the fact that the latter two registers change value relatively frequently, in addition to the use of the 8 bit gray code, the row location wherein these values are stored is continually altered in response to the value of the 10 hour time interval register. Therefore, with each incremental change in the 10 hour time interval register, the instantaneous address location of the 1 hour and 1/16th hour time interval registers is responsively altered, and the number of bit changes of any single memory location in the non-volatile memory device 34 is advantageously minimized.

The plurality of predetermined service time signals are each stored in the memory device 30 as respective 4 bit binary coded decimal numbers. In the preferred embodiment, 16 different service time signals representing service time intervals ranging from 50 hours to 2000 hours, as shown in Table 2, are stored in the working memory area of the microprocessor 20. Alternatively, the service time signals can be stored in and occupy 4 predetermined 16 bit rows of the memory device 30. The combined time signal is stored in one row of the memory device 30 as 4, 4 bit binary coded decimal numbers representing the 1 through 1000 hour registers.

To further extend the life of the non-volatile memory device 34, the frequency of the "store" operation is also minimized. In order to maintain the integrity of the information of the hourmeter display information, data is sent from the processor means 18 to the dynamic memory device 32 with every incremental change of the 1/16th hour time interval register. Therefore, the dynamic memory device always contains information accurate to within 1/16th of one hour. However, "store" operations to the non-volatile memory device 34 normally occur only with each increment of the 10 hour register. Owing to the fact that the 1 hour and 1/16th hour time interval registers always represent the number zero at the time the 10 hour time interval register is incremented, no bit changes occur in the 1 hour and 1/16th hour memory locations during the "store" operation. This further minimizes the number of bit changes that occur in the non-volatile memory device 34.

The 10 hour "store" operations are normally initiated by a command from the processor means 18. In addition, disconnection of the vehicle battery 28 automatically causes a "store" operation to be initiated by the sensing means 36. The low voltage sensor means 42 detects the loss of the $+V_{BAT}$ signal and, prior to the decay of power supplied to the memory device 30, directly causes a "store" operation to be performed by delivering a signal to the "store" input port 118. This is accomplished by turning "off" the transistor 110 and applying a logic 0 signal to the "store" terminal 118. Therefore, integrity of the information stored in the non-volatile memory device 34 is maintained to within at least 1/16th of 1 hour.

In response to $+V_{BAT}$ again being applied to the apparatus 10, the "reset" output terminal 98 of the second voltage regulator 40 is maintained at a logic 0 level for a period of time responsive to the value of the delay capacitor 96. This logic signal is delivered to the "recall" terminal 100 of the memory device 30, and causes the data stored in the non-volatile memory device 34 to be transferred or copied back to the dynamic memory device 32 where it is again available to the processor means 18. In like manner, a logic 0 signal is delivered from the "reset" output terminal 52 of the first voltage regulator 16 to the "reset" port 50 of the processor means 18, and causes the microprocessor 20 to be reinitialized.

Figure 4:
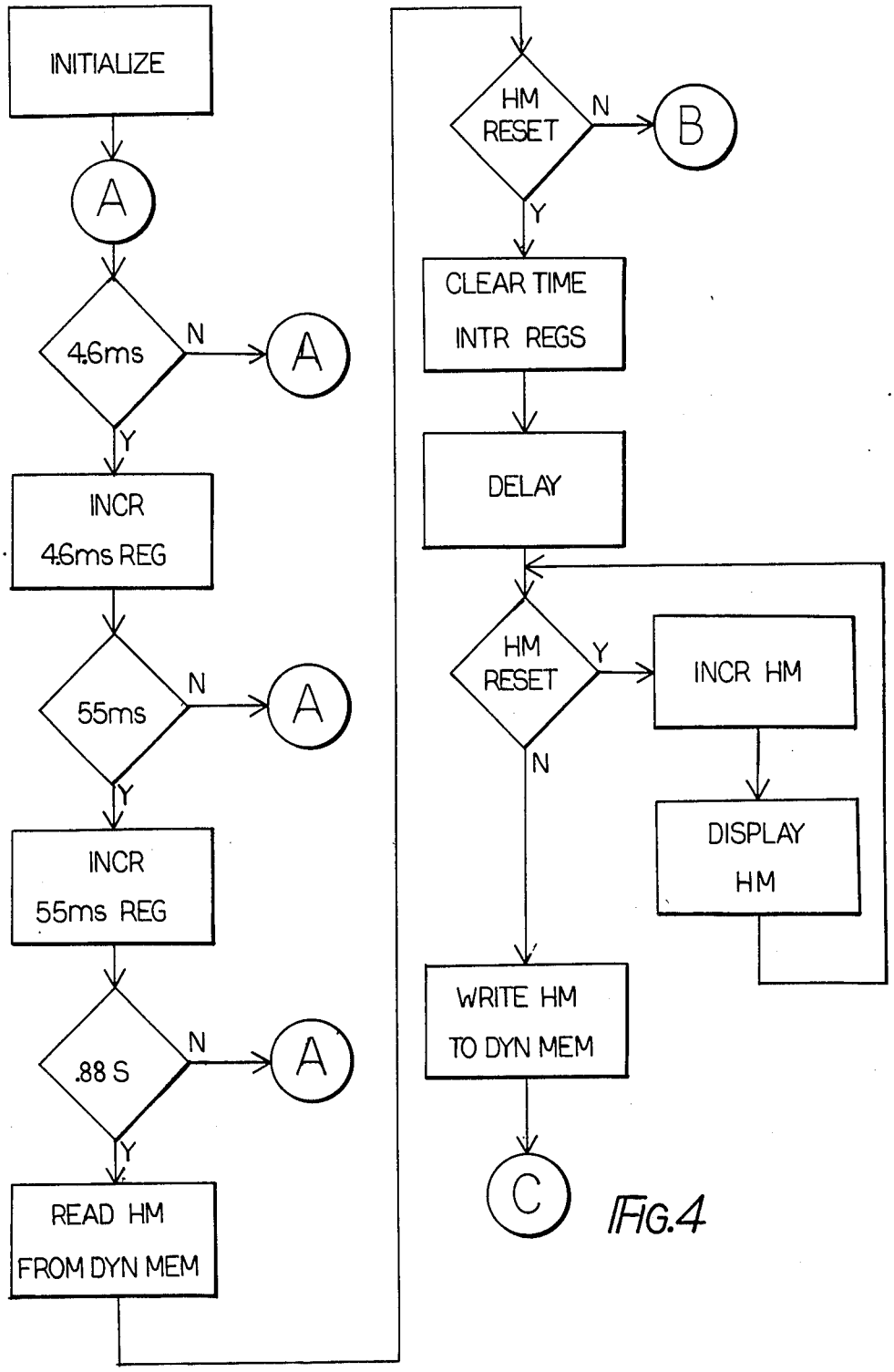
Figure 5:
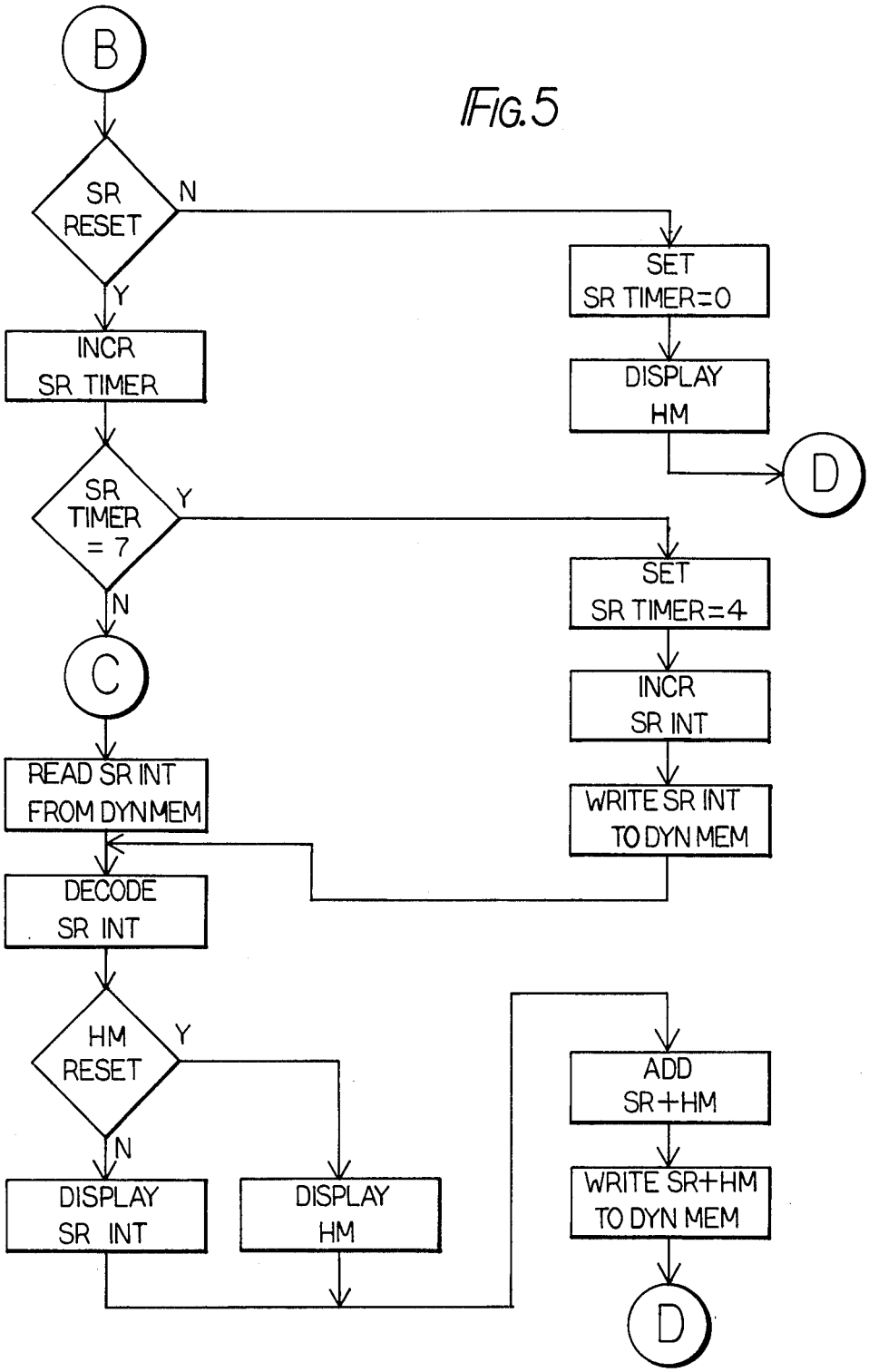
Figure 6:
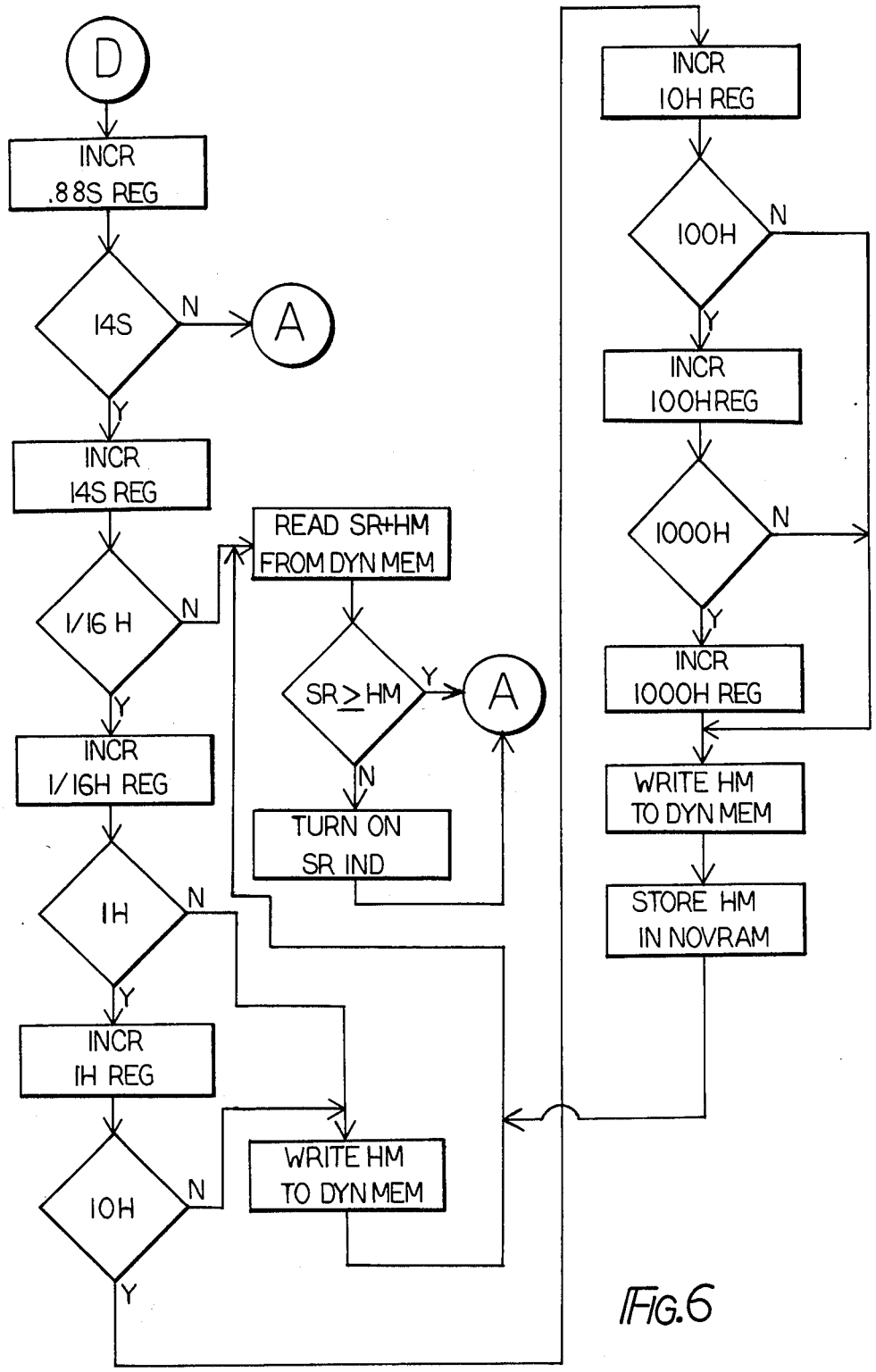

Referring now to FIGS. 4, 5, and 6, a functional flowchart defining the internal programming for the microprocessor 20 is shown. From this flowchart, a programmer of ordinary skill can develop a specific set of program instructions for a general purpose microprocessor that performs the steps necessary for implementation of the instant invention. It will be appreciated that, while the best mode of the invention is considered to include a properly programmed microprocessor, the result of which is the creation of novel hardware associations within the microprocessor and its associated devices, it is possible to implement the instant invention utilizing traditional hard wired circuits.

The respective delay capacitors 96,66 are advantageously selected such that the recall operation is completed before the microprocessor 20 is initialized, ensuring that the microprocessor 20 does not seek data from the dynamic memory device 32 before the data is available.

Upon applying power to the apparatus 10, the microprocessor 20 is initialized, for example, by the logic 0 signal from the first voltage regulator 16, retrieves the accumulated contents of the memory device 30, and begins counting clock cycles received from the oscillator means 22. These clock cycles are counted in the various internal time interval registers maintained in the working memory of the microprocessor and periodically cause overflows of successive ones of these registers. For example, beginning at the Junction "A" clock cycles are counted until a time interval of 4.6 milliseconds has elapsed at which time a 4.6 millisecond register is incremented. Likewise, every 55 milliseconds, a 55 millisecond register is incremented until 0.88 seconds has finally elapsed.

Every 0.88 seconds the accumulated elapsed time is read by the microprocessor 20 from the dynamic memory 32. The elapsed time reset means 24 is checked and, if no elapsed time reset is being called for, control passes to Junction "B" where the service time reset means 23 is checked. If neither reset means 23,24 is active, a service reminder timer is set equal to zero and the total elapsed time contents of the dynamic memory 32 is decoded and displayed as total elapsed hours on the display means 80. Therefore, the accumulated time is displayed 0.88 seconds after power is applied to the apparatus 10 and is updated every 0.88 seconds thereafter.

Control next passes to Junction "D" where the 0.88 second register is incremented, as is a 14 second register, until 1/16th hour elapses. As discussed above, the time interval registers representing 1/16th hour and greater are maintained in both the dynamic and non-volatile memory devices 32,34. After incrementing the 1/16th hour register, the 1 hour interval is checked and the 1/16th through 1000 hour registers are each stored in the dynamic memory device 32. Likewise, if 1 hour has elapsed, the 1 hour register is incremented, a test is made to determine whether 10 hours has elapsed, and each of the registers is stored in the dynamic memory device 32. In either event, following storage in the dynamic memory device 32, the program proceeds to read the combined service reminder plus elapsed time signal from the dynamic memory device 32, as described below.

If 10 hours has elapsed, in the preferred embodiment, the contents of each of the 1/16th through 1000 hour registers is stored in the non-volatile memory device 34. Therefore, when the 10 hour test is true, the 10 hour register is incremented and the 100 hour test performed. Regardless of the outcome of the 100 hour test, the contents of each of the registers is stored first in the dynamic memory device 32 and then is transferred or copied to the non-volatile memory device 34. Likewise, following the 100 hour and 1000 hour intervals, the contents of each of the time interval registers is stored in the dynamic memory device 32 and transferred or copied to non-volatile memory device 34.

Adverting back to the test for a 1/16 hour elapsed time increment, if 1/16 hour has not elapsed the combined time signal is read from the dynamic memory device 32 and compared with the total elapsed time signal. If the elapsed time is less than the combined time, control returns to Junction "A" and the apparatus 10 continues accumulating elapsed time. However, if the elapsed time equals or exceeds the combined time signal, the service status indicator means 79 is energized before continuing with the normal hourmeter function. Therefore, under program control, the service reminder time interval is checked every 14 seconds and the service status indicator means 79 is activated in response to the elapsed time exceeding the programmed predetermined service time interval.

In response to detecting an elapsed time "reset" signal from the second switch means 24, following the 0.88 second time interval, the internal working memory time interval registers are set equal to zero and a delay is initiated. The delay is preferably in the vicinity of a 5 second time period, following which the "reset" signal is again tested. If the "reset" signal is no longer present following the delay, the zero contents of the 1/16th through 1000 hour registers is stored in the dynamic memory device 32. Therefore, activating the second switch means 24 for a period less than the delay period, effectively resets the hourmeter to zero.

If the elapsed time "reset" signal is detected following the delay period, the 1 hour and greater registers begin to increment at a reasonably rapid rate and the incremented value is responsively displayed on the display means 80. The increment and display process continues repeatedly until the "reset" signal is no longer detected. At such time, the current value of the time interval registers is stored in the dynamic memory device 32. Therefore, in response to activating the second switch means 24 for a period greater than the delay period, a desired initial hourmeter setting is established for the apparatus 10. This may be desirable, for example, in the situation where the apparatus 10 is replaced in a vehicle that has accumulated a number of hours of service time. In such case, the new apparatus 10 can be initiated to the value of the removed hourmeter device. In either event, after storing the current value of the time interval registers in the dynamic memory device 32 program control passes to Junction "C", described below.

If no elapsed time reset signal is present following the 0.88 second time interval, control passes to Junction "B" and the service reminder "reset" signal is checked. If the service time "reset" signal from the first switch means 23 is detected, the service timer is incremented by one and checked to determine its present value. If the timer is less than 7, the currently selected service reminder time interval is read from the dynamic memory device 32 and decoded according to Table 2.

Next, the elapsed time reset means 24 is again checked. If no elapsed time "reset" signal is detected, the decoded currently selected service reminder time interval is displayed by the display means 80, the selected service reminder time interval is added to the current total elapsed time value, the combined time signal is stored in the dynamic memory device 32, and program control proceeds to Junction "D" as described above. If the elapsed time "reset" signal is present, the total elapsed time is displayed by the display means 80 instead of the decoded service reminder time interval, and the remaining programmed steps occur as just described.

Following the occurrence of 7 complete loops of 0.88 seconds duration each the timer equals 7, the timer is reset equal to 4, and the currently selected service reminder time is incremented to the next succeeding value shown in Table 2. This value is stored as the new current value in the dynamic memory device 32, decoded and displayed as discussed above.

Therefore, in response to activating the first switch means 23 for a first period of time, the currently selected service reminder time is displayed and a signal equal to the currently selected service reminder time plus the current total elapsed time signal is stored in the dynamic memory device 32, effectively resetting the service reminder and deenergizing the service status indicator means. In response to continuing to activate the first switch means 23 for a second relatively shorter period of time, the currently selected service reminder time is incremented to the next predetermined value before being displayed, combined, and stored.

It will be appreciated by those skilled in the art that it is not essential to incorporate all of the steps represented in the flowchart of FIGS. 4, 5, and 6 in a given system, nor is it necessary to implement the steps of FIGS. 4, 5, and 6 utilizing a microprocessor. However, such an implementation is deemed to be the best mode of practicing the invention owing to the broad and widespread availability of suitable microprocessor circuits, the widespread understanding of programming techniques for such microprocessors, the cost reduction in such circuitry which has been realized in recent years, and the flexibility afforded by such a programmable device.

Other aspects, objects, advantages and uses of this invention can be obtained from a study of the drawings, the disclosure, and the appended claims.

TABLE 1

| DECIMAL | BCD | GRAY CODE |
|---|---|---|
| 0 | 0000 | 00000000 |
| 1 | 0001 | 00000001 |
| 2 | 0010 | 00000011 |
| 3 | 0011 | 00000111 |
| 4 | 0100 | 00001111 |
| 5 | 0101 | 00011111 |
| 6 | 0110 | 00111111 |
| 7 | 0111 | 01111111 |
| 8 | 1000 | 11111111 |
| 9 | 1001 | 11111110 |
| 10 | 1010 | 11111100 |
| 11 | 1011 | 11111000 |
| 12 | 1100 | 11110000 |
| 13 | 1101 | 11100000 |
| 14 | 1110 | 11000000 |
| 15 | 1111 | 10000000 |

TABLE 2

| BCD | SERVICE INTERVAL (HOURS) |
|---|---|
| 0000 | 50 |
| 0001 | 75 |
| 0010 | 100 |
| 0011 | 125 |
| 0100 | 150 |
| 0101 | 175 |
| 0110 | 200 |
| 0111 | 225 |
| 1000 | 250 |
| 1001 | 300 |
| 1010 | 400 |
| 1011 | 500 |
| 1100 | 750 |
| 1101 | 1000 |

TABLE 2-continued

| BCD | SERVICE INTERVAL (HOURS) |
|---|---|
| 1110 | 1500 |
| 1111 | 2000 |

I claim:

1. A programmable service reminder apparatus for a vehicle, said vehicle being controllably energizable from a vehicle power source, comprising:

sensor means for producing a control signal in response to said vehicle being energized;

clock means for producing a periodic time base signal;

service status indicator means for signaling an elapsed period of time;

first switch means for producing a service time reset signal;

programmable memory means for receiving and storing data; and, processor means for receiving said control signal, said periodic time base signal and said service time reset signal;

repeatedly producing an incremental elapsed time signal in response to receiving said control signal and said periodic time base signal and periodically storing the instant elapsed time signal to said programmable memory means;

sequentially producing a plurality of discrete predetermined service time signals in response to receiving said service time reset signal, the number of said predetermined service time signals produced being responsive to the period of time said service time reset signal is continuously received, combining the last stored elapsed time signal and the last produced predetermined service time signal to form a combined time signal, and responsively storing said combined time signal to said programmable memory means; and repeatedly comparing the instant elapsed time signal and said stored combined time signal and energizing said service status indicator means in response to the instant elapsed time signal being greater than said stored combined time signal.

2. A programmable service reminder apparatus, as set forth in claim 1, wherein said first switch means includes magnetic flux responsive means for producing said service time reset signal in response to a predetermined magnetic flux field.

3. A programmable service reminder apparatus, as set forth in claim 2, wherein said magnetic flux responsive means includes a Hall effect switch.

4. A programmable service reminder apparatus, as set forth in claim 3, including second switch means for producing an elapsed time reset signal, said second switch means including a Hall effect switch, and wherein said processor means deenergizes said service status indicator means in response to receiving said elapsed time reset signal.

5. A programmable service reminder apparatus, as set forth in claim 1, wherein said programmable memory means includes a non-volatile random access memory device.

6. A programmable service reminder apparatus, as set forth in claim 5, wherein said service time signals are gray coded digital numbers stored in said non-volatile random access memory device.

7. A programmable service reminder apparatus, as set forth in claim 1, wherein said processor means deenergizes said service status indicator means in response to receiving said service time reset signal.

8. A programmable service reminder apparatus for a vehicle, said vehicle being controllably energizable from a vehicle power source, comprising:

sensor means for producing a digital control signal in response to said vehicle being energized;

clock means for producing a periodic time base signal;

service status indicator means for signaling an elapsed period of time;

a first Hall effect switch adapted to produce a digital service time reset signal in response to being exposed to a predetermined flux field;

programmable memory means for receiving and storing digital data; and, processor means for receiving said digital control signal, said periodic time base signal and said digital service time reset signal;

repeatedly producing an incremental digital elapsed time signal in response to receiving said digital control signal and said periodic time base signal and periodically storing the instant digital elapsed time signal to said programmable memory means;

deenergizing said service status indicator means and sequentially producing a plurality discrete of predetermined digital service time signals in response to receiving said digital service time reset signal, the number of said predetermined service time signals produced being responsive to the period of time said service time reset signal in continuously received, combining the last stored digital elapsed time signal and the last produced predetermined digital service time signal to form a combined digital time signal, and responsively storing said combined digital time signal to said programmable memory means; and repeatedly comparing the instant digital elapsed time signal and said stored digital combined time signal and energizing said service status indicator means in response to the instant elapsed time signal being greater than said stored combined time signal.

9. The method for controllably operating a programmable service reminder apparatus associated with a vehicle, said vehicle being controllably energizable from a vehicle power source, comprising the steps of:

producing a control signal in response to said vehicle being energized;

producing a periodic time base signal;

controllably producing a service time reset signal;

receiving said periodic time base signal and said service time reset signal;

repeatedly producing an incremental elapsed time signal in response to receiving said control signal and said periodic time base signal;

periodically storing the instant elapsed time signal to a programmable memory means;

sequentially producing a plurality of discrete predetermined service time signals in response to receiving said service time reset signal, the number of said predetermined service time signals produced being responsive to the period of time said service time reset signal is continuously received, combining the last stored elapsed time signal and the last produced predetermined service time signal to form a combined time signal, and storing said combined time signal to said programmable memory means;

repeatedly comparing the instant elapsed time signal and said stored combined time signal; and energizing a service status indicator means in response to the instant elapsed time signal being greater than said stored combined time signal.

* * * * *